United States Patent [19]

Braeutigam

[11] Patent Number: 5,022,527

[45] Date of Patent: Jun. 11, 1991

[54] BOOK CONTAINER

[75] Inventor: Robert O. Braeutigam, Chalfont, Pa.

[73] Assignee: FMC Corporation

[21] Appl. No.: 520,418

[22] Filed: May 8, 1990

[51] Int. Cl.[5] ..... D65D 81/26; D65D 81/04; D65D 85/62

[52] U.S. Cl. ..... 206/522; 206/424; 206/508; 206/526; 206/814; 206/807; 220/913; 220/DIG. 14

[58] Field of Search ..... 206/522, 424, 508, 526, 206/814, 807; 220/913, DIG. 14

[56] References Cited

U.S. PATENT DOCUMENTS

| | | | |
|---|---|---|---|
| 2,695,115 | 11/1954 | Roop | 206/508 |
| 2,739,734 | 3/1956 | Pagh | 220/913 |
| 3,199,689 | 8/1965 | Feldkamp | 206/522 X |
| 3,403,713 | 10/1968 | Good et al. | 206/522 X |
| 3,514,157 | 5/1970 | Geiser | 206/522 X |
| 3,619,825 | 11/1971 | Taub et al. | 206/522 X |
| 4,101,052 | 7/1978 | Dove | 206/807 |

FOREIGN PATENT DOCUMENTS

| | | | |
|---|---|---|---|
| 3827858 | 3/1989 | Fed. Rep. of Germany | 206/522 |
| 1365481 | 5/1964 | France | 206/508 |
| 1551895 | 11/1968 | France | 206/522 |
| 2391121 | 1/1979 | France | 206/522 |

*Primary Examiner*—William I. Price

*Attorney, Agent, or Firm*—Ronald C. Kamp; R. B. Megley

[57] ABSTRACT

A container for holding books during transport and treatment with a liquid including a means which can be moved between a pressing position to hold the books securely during transport and a relaxed position in which the books are free to separate to facilitate penetration of the treatment liquid and the escape of moisture.

7 Claims, 2 Drawing Sheets

FIG_1
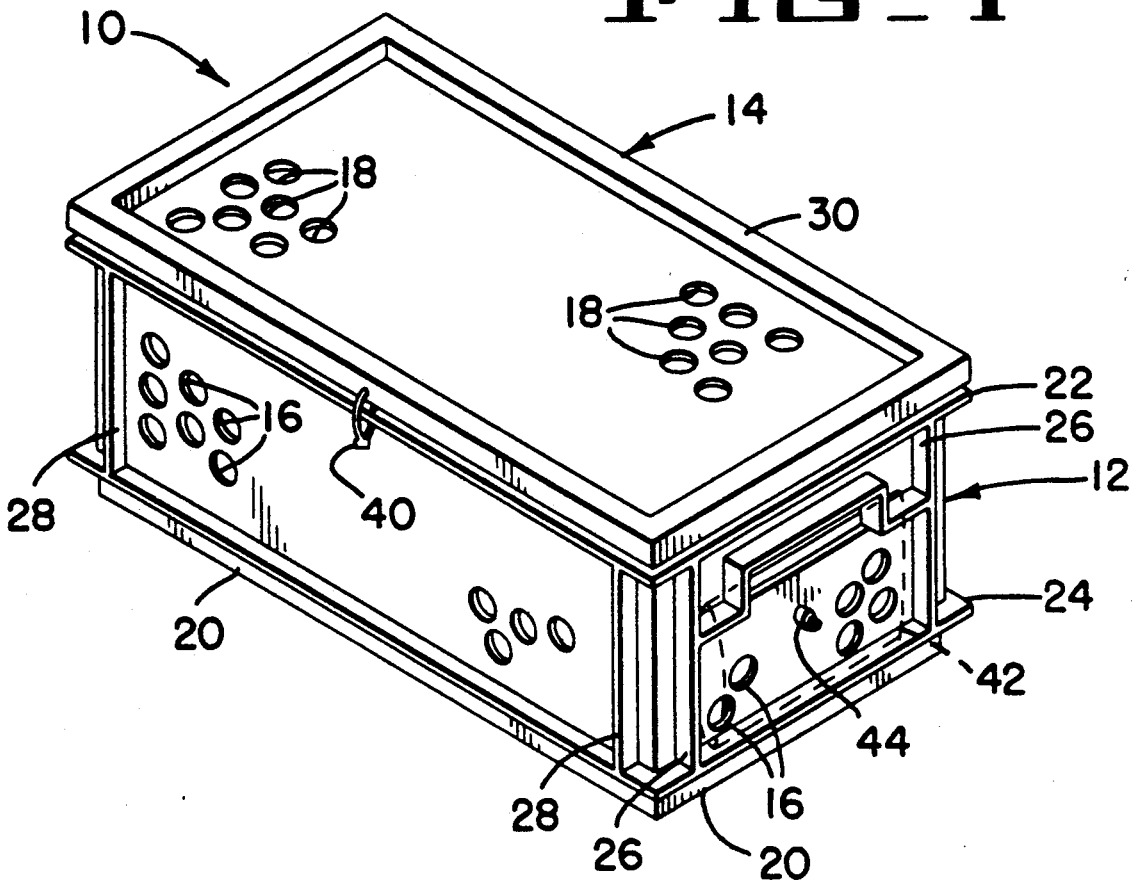
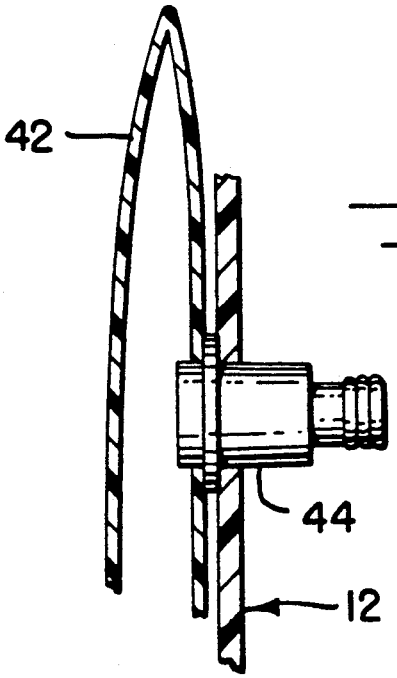
FIG_4

BOOK CONTAINER

This invention relates to containers for holding a plurality of books, and more particularly, to such containers which may be used in a process for treatment of a large quantity of books.

Books that have been printed on acid-paper, which encompasses the majority of those books produced in the last one hundred years or so, will eventually deteriorate unless treated to neutralize the acid. Treatment procedures have been devised to effect such neutralization, such as the process disclosed and claimed in pending U.S. Pat. applications Ser. No. 07/416,076, filed on Oct. 2, 1989 by Clyde D. Watson and Erik Thuse, and entitled "BOOK DEACIDIFICATION METHOD AND APPARATUS"; U.S. Ser. No. 07/416,166, filed on Oct. 2, 1989 by Conrad W. Kamienski, Robert S. Wedinger, James L. Manganaro, John E. Dabrowski, Anthony J. DeJessa, Clyde D. Watson and Erik Thus, and entitled "BOOK DEACIDIFICATION METHOD AND APPARATUS and U.S. Ser. No. 07/416,293, filed on Oct. 2, 1989 by James L. Manganaro, John E. Dabrowski and Anthony J. DeJessa, and entitled "BOOK DEACIDIFICATION METHOD AND APPARATUS".

The large equipment required in such procedures dictate that a central processing facility or facilities be constructed and the books transported from nearby libraries to the facility and then returned to the appropriate library following treatment at the facility. Several concerns need to be addressed in this process. The integrity of each library's collection needs to be assured. The possibility of damage to the books needs to be minimized. The books must also be physically presented to, and maintained during, the treatment procedure in a manner such that the deacidification is uniformly effective. Finally, there are literally millions of books that will require deacidification which suggests a mass-production approach to the process of removal of these books from shelves, packing them for transport, transporting them from the library to the treatment facility, treating them, transporting them back to the library and reshelving them.

The present invention provides a book container which securely holds the books during transport and handling to prevent or minimize damage to them, which permits the books to be easily loaded into and removed therefrom, which insures the integrity of the collection, which maintains the shelving order throughout the process, which facilitates the removal of moisture from, and the penetration of treatment liquid into, the books, and/or is readily adapted to a mass-production process for handling large quantities of books.

These and other advantages of the present invention will become more readily apparent from a perusal of the following description of a preferred embodiment and the accompanying drawings, wherein:

FIG. 1 is an isometric view of a book container according to the present invention;

FIG. 4 is a detail of the valve associated with the air bag.

Figure 2:
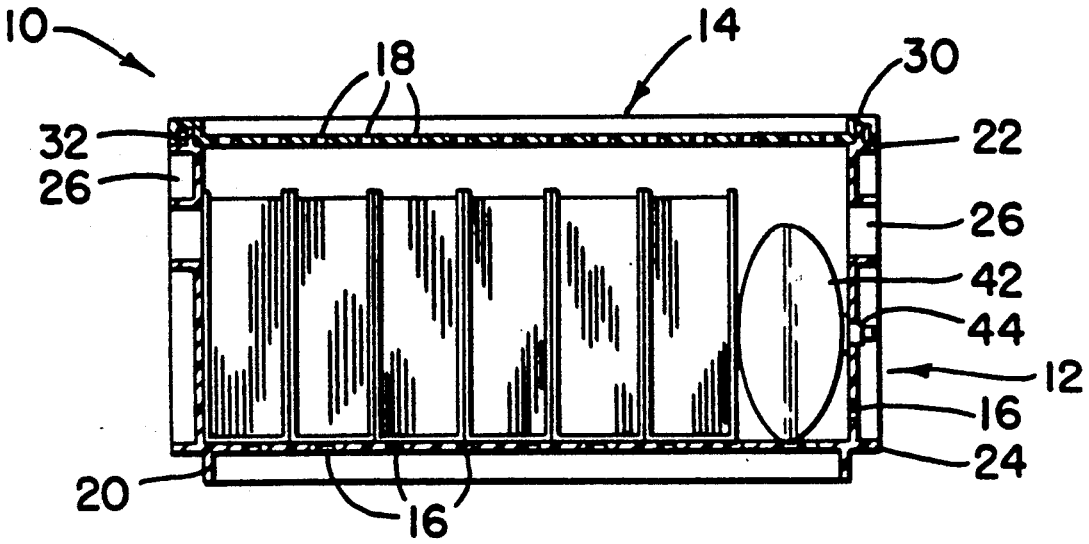
FIG. 2 is a vertical section taken on the longitudinal axis of the container shown in FIG. 1.
Figure 3:
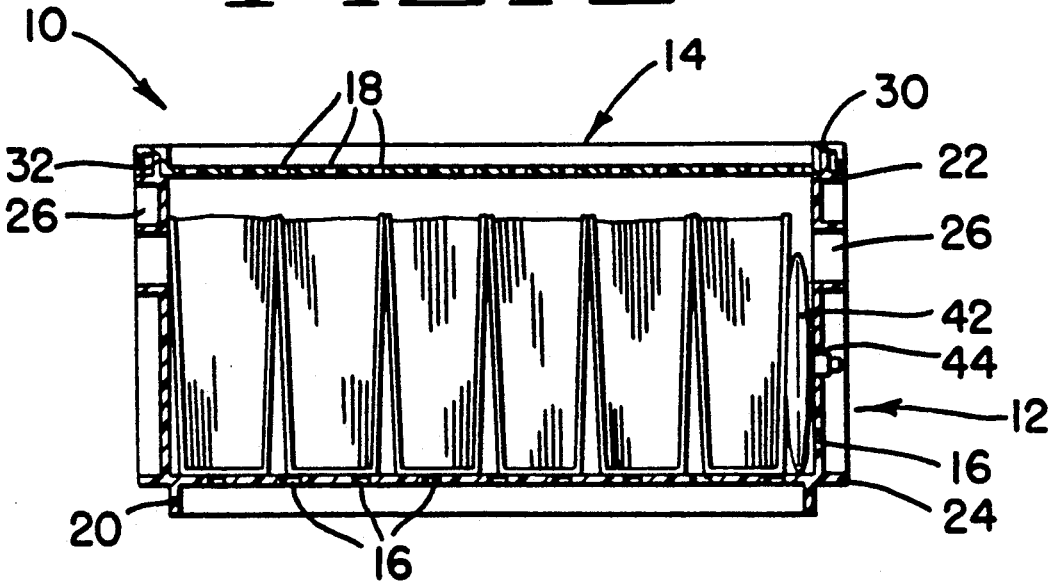
FIG. 3 is a view similar to FIG. 2 but showing the air bag contracted, rather than expanded as it is in FIG. 2.

Referring to FIG. 1, there is shown a container, indicated generally at 10, which consists of an open-topped carton 12 for holding a plurality of books and a lid 14 engageable with the open top of the carton 12. The four sides and bottom of the carton 12 are provided with openings 16 to permit liquid to enter and drain from the interior of the carton 12 and also to allow vapor or moisture to escape. The lid 14 is also provided with similar openings 18 for the same purpose. The treatment for deacidification requires an initial removal of residual moisture from the books, immersion in a treatment liquid, at least one liquid solvent rinsing to flush out the treatment liquid, with draining required after each liquid, and then drying, Thus, the ability of the container 10 to permit the ready flow of liquids into and out of the container 10 is important; as is permitting the escape of water and solvent vapor.

Dielectric or microwave heating is a favored means to dry the books. Thus, both the carton 12 and the lid 14 must be made of material which is not affected by such energy forms or temperatures of about 160° F. Suitable materials include high density polyethylene or polypropylene. Such materials are also relatively lightweight, capable of supporting the loads imposed by the weight of the books and may be readily molded. However, since the containers will be moved on mechanical conveyors, such as powered roller conveyors, for example, and may be stacked on top of each other during shipment on trucks between the facility and the library, stiffening flanges are desirable, if not necessary. A bottom flange 20 extends around the periphery of the bottom of the carton 12 to add stiffness and strength. This flange 20 also serves to elevate the bottom above the support surface so that dirt, debris and protruding objects are less likely to enter the holes 16 in the bottom and damage the books in the container 10. Upper and lower flanges, 22 and 24 respectively, extend around, and protrude from, the four sides of the carton 12. These flanges not only stiffen and strengthen the sides and protect the books, as mentioned above, but also absorbs the forces imposed by, and resist deflection normally resulting from, impact with adjacent containers. Inner and outer vertical flanges 26 and 28 extending between the upper and lower flanges 22 and 24 may also be provided at each corner for the same purposes.

The lid 14 has a raised rim 30 which extends around its periphery with a downwardly open channel which snaps over and engages an upstanding lip 32 formed on the upper flange 22. The lip 32 is offset from the plane of the sides so that the bottom flanges 20 can fit within the rim 30 to facilitate stable vertical stacking of the containers 10 when filled with books. The sides of the carton 12 are tapered, i.e., flair outward from bottom to the top, so that the cartons 12 may be compactly stacked when empty. Security for the books is provided by a lock means to secure the lid 14 to the carton 12. Such means must not be made of metal, to permit microwave or dielectric drying of the books, and preferably comprise plastic seals 40 extending through aligned holes in the middle of the rim 30 and the top flange 22.

To prevent the books from moving relative to the container as well as relative to each other, and the possible damages as a consequence of such movement during shipment and handling, an air bag 42 is positioned at one or both ends of the carton 12. A push-pull valve 44 extends through, and is secured to, the side of the carton 12. After the books are packed into the carton, the air bag 42 is inflated by connecting a source of air pressure to the valve 44 in its outward or open position, as shown in FIG. 4. The bag 42 is thereby expanded to press the books together and against the opposite side of the carton. Once expanded, the source is disconnected and the valve 44 is pushed inward to its closed position. The books are thus held securely for transport to the treatment facility. At the facility, the valve 44 is opened so the air inside the bag 42 can escape. The jostling of the container as it is conveyed will permit the books to separate from each other so that effective and thorough treatment of the books will be achieved. When such treatment is accomplished the bag 42 is reinflated and the valve 44 closed for secure transport of the books back to the library. The valve 44 is then opened, the seals 40 removed and the lid 14 removed to permit the books therein to be reshelved. It is important to note that the valve 44 may be opened and closed, and the bag 42 collapsed and inflated, entirely from the exterior of the container, i.e., with the lid 14 sealed to the carton. The possibility of books being lost or stolen is therefore minimized since the containers are sealed at the library and returned in that condition to the library.

The containers may also be stacked, conveyed and treated with the lid 14 down. Packing the books into the carton 12 is usually more easily accomplished with the spines of the books facing upward. However, treatment is best accomplished with the spines downward, permitting the pages of the books to open more freely. Thus, the containers may be inverted after loading the books into the carton 12 and securing the lid 14. Since the containers will be conveyed on their lids, the seals 40 should extend through the side, rather than the top, of the rim 30.

While a preferred embodiment of the present invention has been shown and described herein, it will be appreciated that various changes and modifications may be made therein without departing from the spirit of the invention as defined by the scope of the appended claims.

What is claimed is:

1. A means for holding books during transport and treatment with a liquid comprising:

a container having a bottom and opposed sides for accepting a plurality of books;

said sides having openings to permit the flow of liquid and vapors therethrough; and first means carried by one of said sides and being moved between a first position in which the books are pressed against each other and the side opposite said one side to urge said container and books to move as a unit and a second position in which said books are free to separate to facilitate the escape of moisture from, and the penetration of treatment liquid into, said books.

2. The invention according to claim 1, and further comprising:

seal means for securing said lid to said container; and actuating means operable from the exterior of said secured lid and container for controlling said first means.

3. A means for holding books during transport and treatment comprising;

a carton having a bottom and four sides connected to form an open top for removably accepting a plurality of books to be treated;

a lid complementary to and engageable with said open top;

said lid, bottom and sides having openings to facilitate the flow of vapor and liquid therethrough;

a releasable retainer means for holding said books tightly engaged during transport and, when released, permitting said books to separate so that treatment is facilitated.

4. The invention according to claim 3 and further comprising:

first flange means extending downward from said bottom to elevate and support said bottom above a surface supporting said containers.

5. The invention according to claim 3 and further comprising:

second flange means extending outward from said sides.

6. The invention according to claim 5 wherein said second flange means comprises:

upper and lower flanges encircling the periphery of said sides.

7. The invention according to claim 2 wherein said seal means and said actuating means can tolerate radio and microwave energy without damage.

* * * * *